US010047518B2

(12) United States Patent
MacDonald

(10) Patent No.: US 10,047,518 B2
(45) Date of Patent: Aug. 14, 2018

(54) VENTILATING SILL PLATE

(71) Applicant: James MacDonald, Kirkland (CA)

(72) Inventor: James MacDonald, Kirkland (CA)

(73) Assignee: 9619674 Canada Inc., Kirkland (CA)

( * ) Notice: Subject to any disclaimer, the term of this patent is extended or adjusted under 35 U.S.C. 154(b) by 0 days.

(21) Appl. No.: 15/160,933

(22) Filed: May 20, 2016

(65) Prior Publication Data

US 2016/0340893 A1 Nov. 24, 2016

Related U.S. Application Data

(60) Provisional application No. 62/164,798, filed on May 21, 2015.

(51) Int. Cl.

| | |
|---|---|
| ***E04B 1/70*** | (2006.01) |
| ***E04B 1/64*** | (2006.01) |
| ***E04C 2/52*** | (2006.01) |
| *E04B 1/26* | (2006.01) |

(52) U.S. Cl.

CPC ..... *E04B 1/7076* (2013.01); *E04B 1/644* (2013.01); *E04C 2/523* (2013.01); *E04B 2001/268* (2013.01)

(58) Field of Classification Search

CPC ..... E04B 1/644; E04B 1/7053; E04B 1/7069; E04B 1/7076; E04B 2001/268; E04C 2/523; E04H 9/145

USPC ..... 52/169.5, 302.1, 302.6, 302.7

See application file for complete search history.

(56) References Cited

U.S. PATENT DOCUMENTS

| | | | | | |
|---|---|---|---|---|---|
| 3,314,201 | A * | 4/1967 | Riegelman | E06B 7/14 | 49/408 |
| 5,468,184 | A * | 11/1995 | Collier | F24F 7/08 | 454/186 |
| 6,003,279 | A * | 12/1999 | Schneider | E04B 1/0046 | 403/230 |
| RE36,676 | E * | 5/2000 | Sourlis | E04B 1/644 | 52/169.5 |
| 6,647,691 | B2 * | 11/2003 | Becker | E04B 2/7457 | 403/242 |

(Continued)

FOREIGN PATENT DOCUMENTS

| | | | | |
|---|---|---|---|---|
| EP | 3085845 | A1 * | 10/2016 | E04B 1/70 |
| GB | 2497971 | A * | 7/2013 | E04B 5/48 |

*Primary Examiner* — Charles A Fox
*Assistant Examiner* — Joseph J. Sadlon
(74) *Attorney, Agent, or Firm* — Fasken Martineau DuMoulir

(57) ABSTRACT

A ventilating sill for elevating a wall partition from a floor surface in order to isolate the wall partition from moisture and humidity that can emanate from the floor surface or be present thereon. The ventilating sill includes a block having a support surface, a base surface, two opposed side surfaces and a plurality of spaced channels extending between the side surfaces forming channeled surfaces. The ventilating sill further includes a pair of slats, each slat extending from each side surface upwardly towards the wall partition at a right angle to the support surface, the slats defining a support area, and being adapted to guide the wall partition onto the support surface and at least one aperture communicating between the support area and an ambient environment for ventilating the support area and draining moisture and humidity therefrom.

15 Claims, 9 Drawing Sheets

(56) References Cited

U.S. PATENT DOCUMENTS

| | | | | |
|---|---|---|---|---|
| 6,941,703 | B2 * | 9/2005 | MacLean | A01K 1/0103 137/312 |
| 8,099,912 | B2 * | 1/2012 | DeJonge | F24F 13/082 292/200 |
| 8,555,586 | B2 * | 10/2013 | Lowe | E03F 1/005 210/170.03 |
| D711,020 | S * | 8/2014 | Cochren | D25/113 |
| 9,085,892 | B1 * | 7/2015 | Wilson | E04B 1/70 |
| 2006/0026911 | A1 * | 2/2006 | Sutton | E04B 2/7457 52/169.5 |
| 2009/0223147 | A1 * | 9/2009 | Spignesi | E04D 13/0431 52/169.5 |
| 2011/0225911 | A1 * | 9/2011 | Battisti | E04B 2/7409 52/302.1 |

* cited by examiner

VENTILATING SILL PLATE

CROSS-REFERENCE TO RELATED APPLICATIONS

The present patent application claims the benefits of priority of commonly assigned Provisional Patent Application no. 62/164,798, entitled "Ventilating Sill Plate" and filed at the United States Patent Office on May 21, 2015, the content of which is incorporated herein by reference.

FIELD OF THE INVENTION

The present invention relates to underlayment ventilation and moisture control. More particularly, the present invention relates to a ventilating sill elevating a wall partition from a floor surface to isolate the wall partition from moisture and humidity.

BACKGROUND OF THE INVENTION

Conventional walls or structures inside a building are prone to various environmental and interior building factors such as heat, moisture and humidity. Wall design can be optimized to control, prevent or manage these factors.

Water leaks, floods and water vapor are sources of moisture and humidity that can damage the wall structures. Basements are particularly at a higher risk of floods and water leaks because they are either completely or partially below ground level.

Moisture usually migrates up through the building from basements and crawl spaces, particularly where no vapor barrier is placed on or below floors, walls, structures or surfaces. Moisture can also condense when its ambient temperature is cooled to its dew point. At the dew point, surplus water vapor condenses and wets the nearest surface. In addition, wall partitions constructed over concrete surfaces are especially prone to moisture and humidity.

Vapor barriers and base plates may be used to isolate wall partitions. However, such barriers or plates may cause moisture and humidity to accumulate and become trapped beyond the barrier or plate and further damage the wall partitions. Attempts to resolve this issue have been made in the past such as the design Pat. Nos. US D727,533S and US D711,020S. These designs correspond to wall footers wherein the base surface comprises a plurality of cylindrical protrusions adapted to create a gap between the wall partition and the ground. However, in such designs, the wall partition lay flat on the device, thus restraining the moisture accumulated between the footer and the wall to escape. Furthermore, the protrusions are substantially thin, which limits a water flow in a flood event. The protrusions are also not aligned in the direction of the thickness of the wall thus creating an increased resistance since the water must change direction to avoid the protrusions.

Other prior art includes a product as disclosed U.S. Pat. No. 8,915,044. The patent '044 discloses a mounting clip creating a gap between a gypsum board and the ground to prevent moisture damage. In the event of a flood, such clip does not allow water to flow underneath the wall. Furthermore, moisture or humidity may remain trapped between the clip and the gypsum board. The accumulated moisture will thus increase damage to the wall over time. Moreover, such device is not adapted to support heavy loads.

There is thus a need for a ventilating sill to protect the wall partition from moisture and humidity while draining excess moisture and humidity.

Hence, in light of the aforementioned, there is a need for an improved system which, by virtue of its design and components, would be able to overcome some of the above-discussed prior art concerns.

SUMMARY OF THE INVENTION

One object of the present invention is to provide a solution to at least one of the abovementioned prior art drawbacks.

The present invention relates to a ventilating sill for elevating a wall partition from a floor surface to isolate the wall partition from moisture and humidity.

In accordance with an aspect of the present invention, there is provided a ventilating sill comprising:

- a block having a support surface, a base surface, and two opposed side surfaces, placeable between the floor surface and the wall partition for isolating the wall partition from the floor surface, said block having a plurality of spaced channels extending between the side surfaces forming channeled surfaces;
- a pair of slats, each slat extending from each side surface upwardly towards the wall partition at a right angle to the support surface, the slats defining a support area, and being adapted to guide the wall partition onto the support surface; and
- at least one aperture communicating between the support area and an ambient environment for ventilating the support area and draining moisture and humidity therefrom.

In some implementations, the support surface further comprises a recess mounted around the at least one aperture for guiding the moisture towards the at least one aperture.

In some implementations, the block is made from a material selected from a group consisting of plastics, composites, and metals.

In some implementations, the slats may be made from a material selected from the group consisting of plastics, composites, and metals.

In some implementations, the ventilating sill may further comprise a screen mesh insect barrier positioned over the channeled surfaces.

The invention is directed to a ventilating sill for elevating a wall partition from a surface, the ventilating sill comprising:

- a portion having a support surface, a base surface, and two opposed side surfaces, the portion being placeable underneath the wall partition;
- a plurality of channels extending between the side surfaces;
- a pair of slats, each slat upwardly extending from each side surface towards the wall partition, the slats defining a support area and being adapted to guide the wall partition onto the support surface; and
- at least one aperture communicating between the support area and an ambient environment, the at least one aperture being adapted to drain the support area.

In a preferred embodiment, the support surface comprises a recess mounted around the at least one aperture for guiding moisture towards the at least one aperture. The portion and the at least one slat are preferably made from a material selected from a group consisting of plastics, composites and metals.

Also according to a preferred embodiment, the ventilating sill may further comprise a screen mesh insect barrier positioned over the channels. Spring clips or fasteners may also be used for securing the wall partition to the ventilating sill.

The invention is also directed to ventilating wall partition, the wall partition comprising:

a liquid permeable portion comprising:

a base surface;

two opposed side surfaces; and a plurality of spaced apart channels extending between the side surfaces of the liquid permeable portion;

a load carrying portion being vertically superposed with regards to the liquid permeable portion, In a preferred embodiment, the load carrying portion is on top of the liquid permeable portion. The ventilating wall partition may also comprise a plurality of load carrying portions vertically superposed and placed in alternation. Both portions are preferably made from an anti-mold material selected from a group of plastic, composite, or metal. The liquid permeable portion may also comprise a screen mesh insect barrier positioned over the channels.

The invention is further directed to a method for preventing mold on a wall partition, the method comprising the step of disposing a ventilating sill between the wall partition and a floor, the ventilating sill comprising a plurality of spaced apart channels disposed along the length of the wall partition for allowing water to flow from a side of a wall to another side of the wall.

The method may also comprise the step of evacuating humidity or moisture from a volume delimited by the wall partition, a support area of the ventilating sill and a pair of slats extending upwardly from the ventilating sill and disposed along the length of the wall, the moisture being evacuated through an aperture connecting the volume and an ambient environment.

The method may also comprise the steps of attaching the ventilating sill to the wall partition using fasteners or spring clips and disposing a screen mesh insect barrier over the channels The invention is yet further directed to a method for creating a mold proof wall, the method comprising the step of using a ventilating wall partition disposed between structural elements of the wall and a floor, the ventilating wall partition comprising a plurality of spaced apart channels disposed along the length of the wall for allowing water to flow from a side of the wall to another side of the wall.

The method may further comprise the step of disposing a screen mesh insect barrier over the channels.

The features of the present invention which are believed to be novel are set forth with particularity in the appended claims.

BRIEF DESCRIPTION OF THE DRAWINGS

The above and other objects, features and advantages of the invention will become more readily apparent from the following description, reference being made to the accompanying drawings in which.

DETAILED DESCRIPTION OF THE PREFERRED EMBODIMENT

Figure 1:
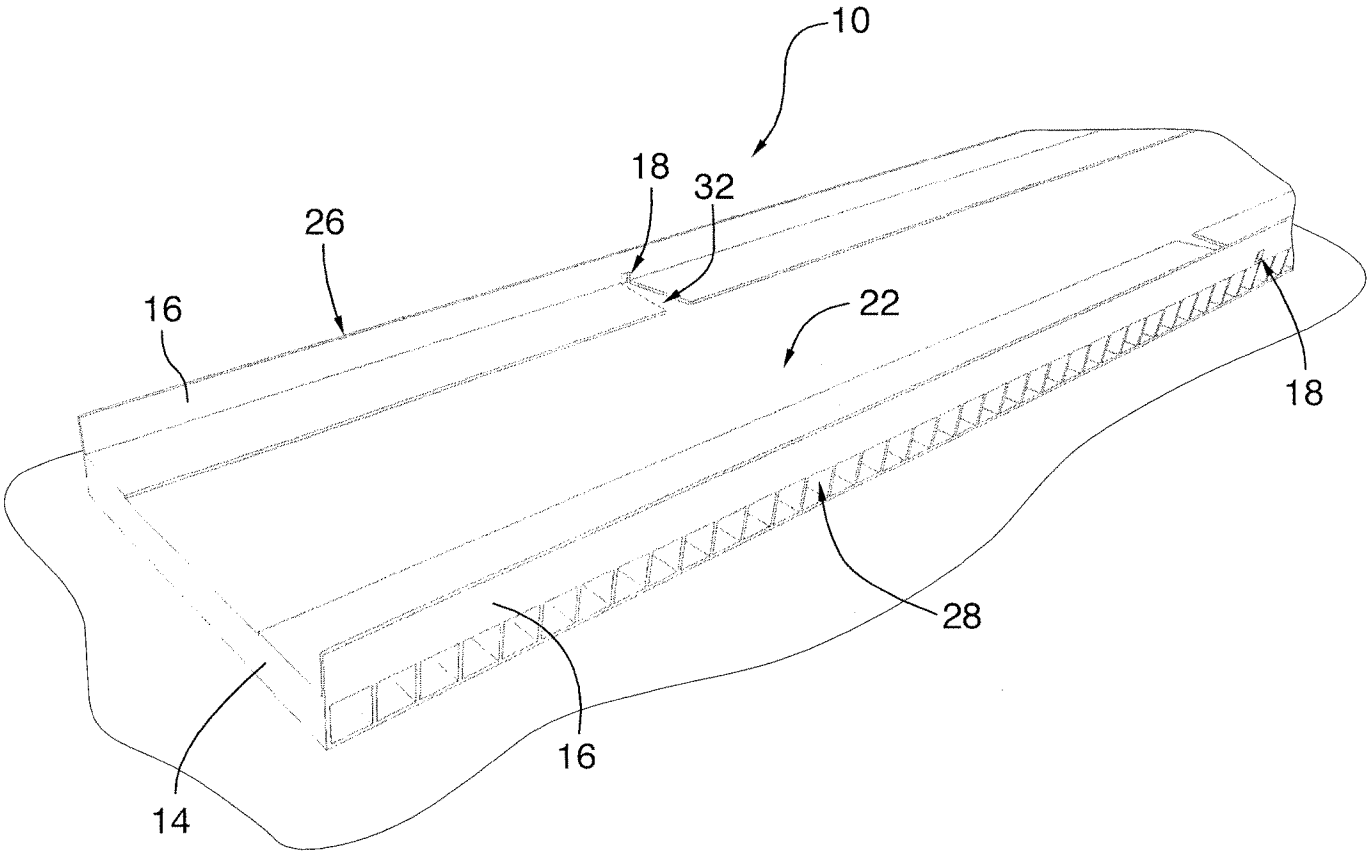
FIG. 1 is a perspective view of a ventilating sill according to an embodiment of the present invention.
Figure 2:
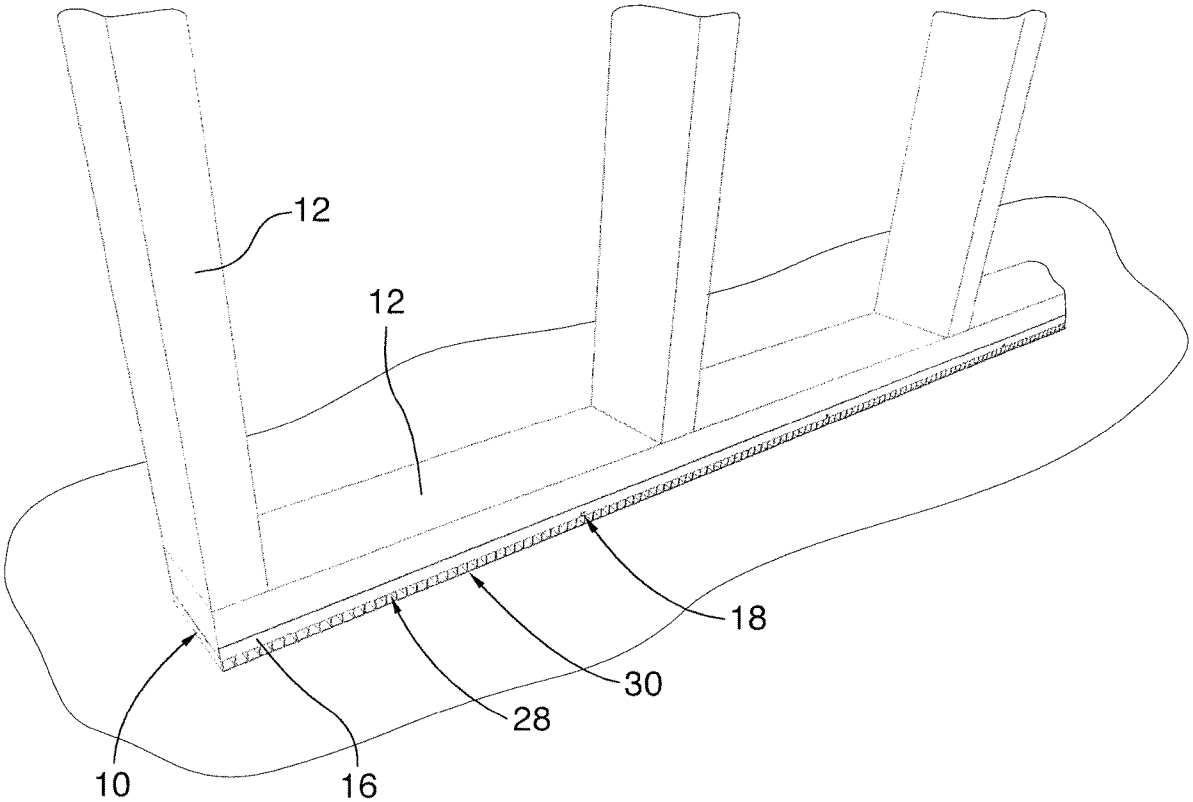
FIG. 2 is another view of what is shown in FIG. 1, with a wall partition installed on the ventilating sill.
Figure 3:
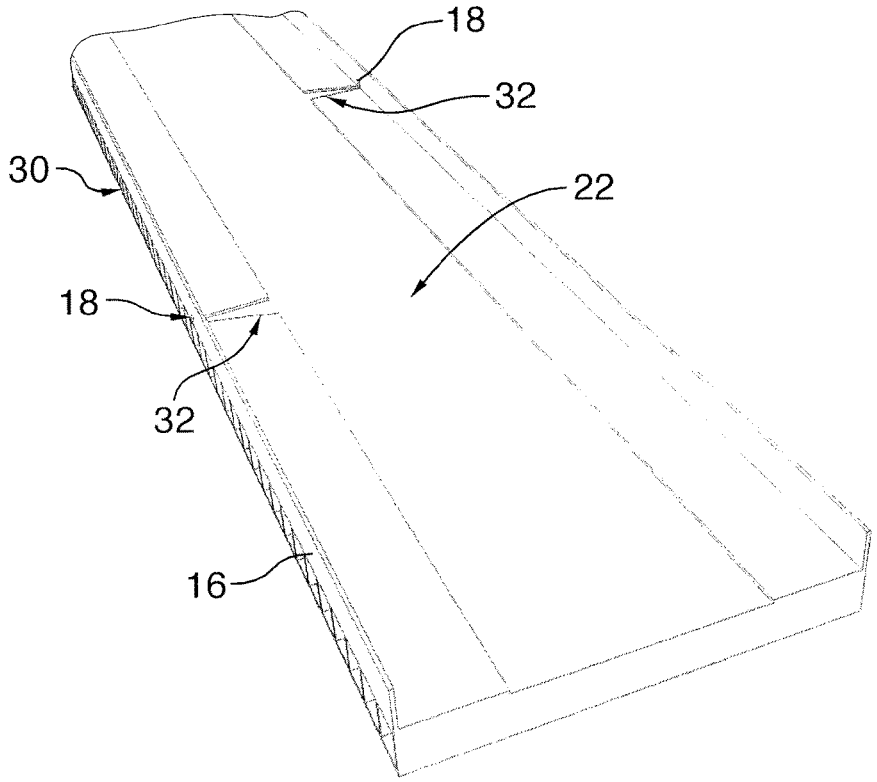
FIG. 3 is another view of what is shown in FIG. 1.
Figure 4:
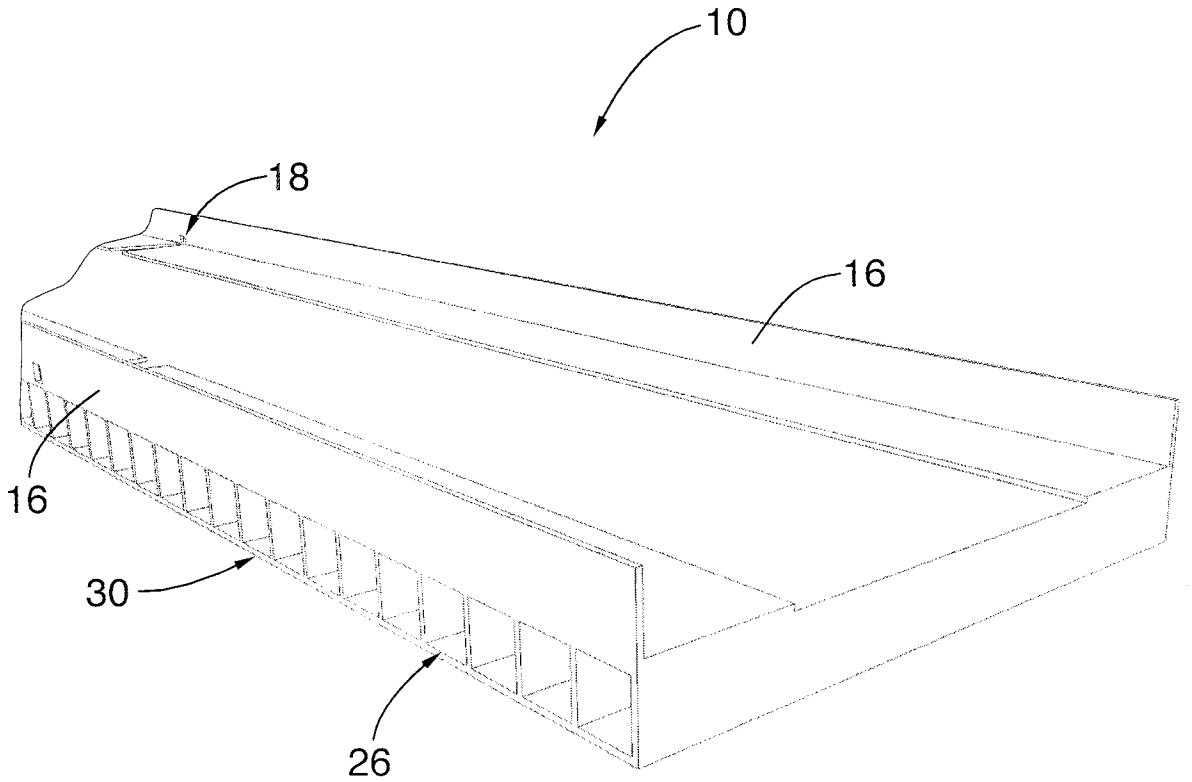
FIG. 4 is another view of what is shown in FIG. 1.
Figure 5:
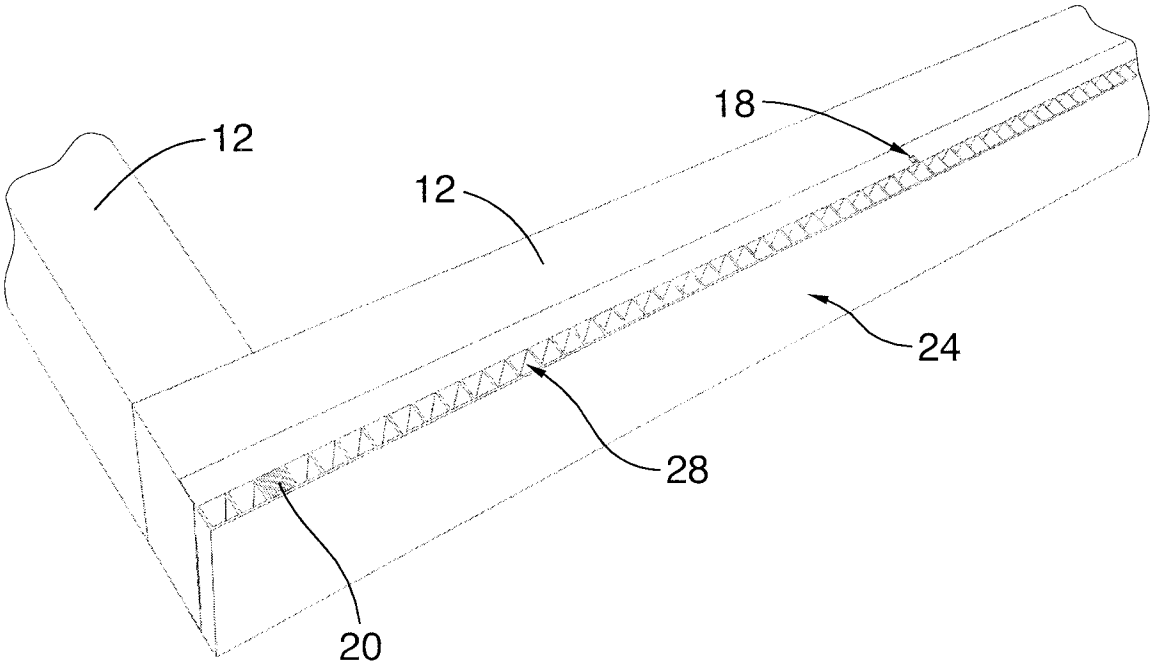
FIG. 5 is another view of what is shown in FIG. 2.
Figure 6:
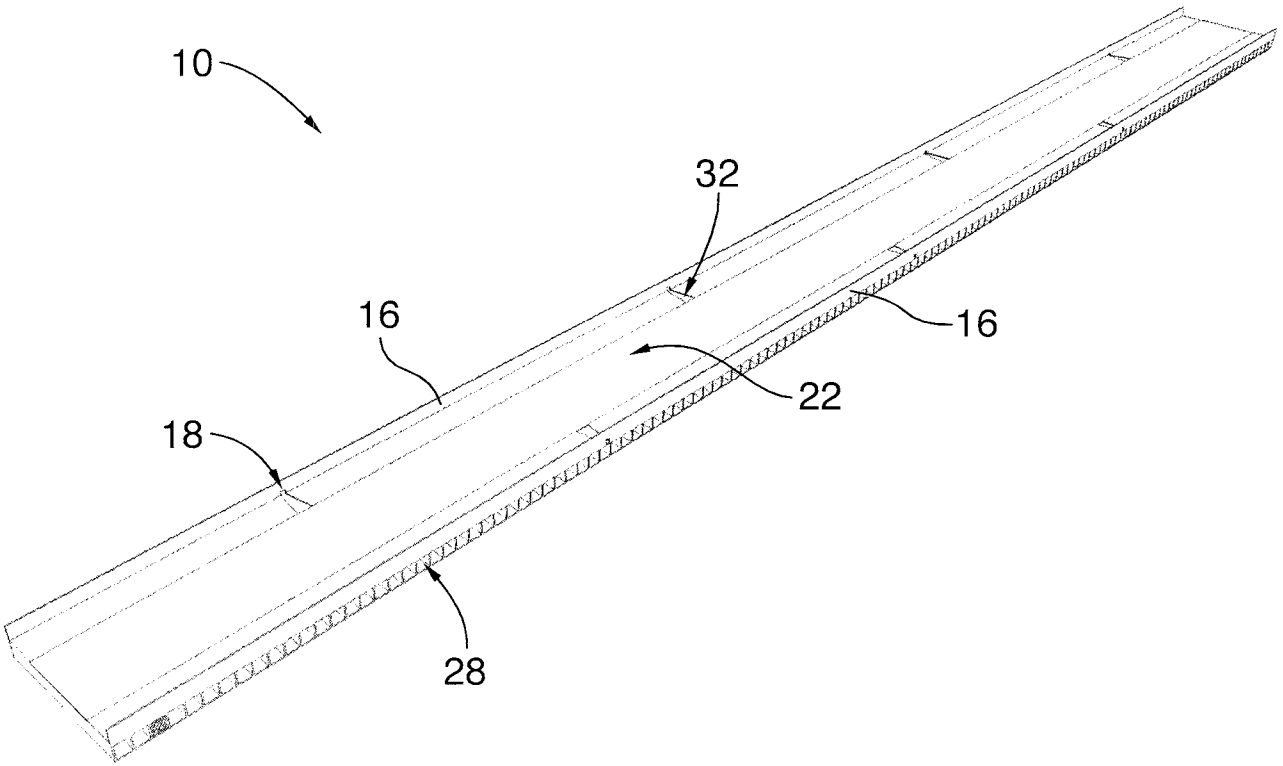
FIG. 6 is a perspective view of the ventilating sill.

A novel Ventilating Sill Plate will be described hereinafter. Although the invention is described in terms of specific illustrative embodiment(s), it is to be understood that the embodiment(s) described herein are by way of example only and that the scope of the invention is not intended to be limited thereby.

As shown in FIGS. 1 to 7, there is provided a ventilating sill 10 for elevating a wall partition 12 from a floor surface (not shown) to isolate the wall partition 12 from moisture and humidity that can emanate from the floor surface or be present thereon. The ventilating sill plate may be manufactured in any size as to conform to the dimensions of any type or format of wall. The ventilating sill may be adapted to a wall made from material such as, but not limited to, metal, wood, and the likes.

In some embodiments, the ventilating sill 10 comprises a block 14, a pair of slats 16 and at least one aperture 18. In other embodiments, the ventilating sill 10 may further comprise a screen mesh insect barrier 20.

The ventilating sill 10 is typically placed between the floor surface and the wall partition 12 to protect the wall partition 12 from moisture and humidity emanating from the floor surface or from water leaks or the like.

The block 14 generally defines a support surface 22 for receiving the wall partition 12 and a base surface 24 for contacting the floor surface. The support surface 22 is delimited by two opposite side surfaces 26 and is preferably sized according to the width of the wall partition 12. Preferably, the support surface 22 comprises a recess 32 mounted around the at least one aperture 18 for guiding any moisture and humidity towards the at least one aperture 18. The block 14 is preferably made from plastics, composites or metals. Understandably, any other materials may be used as known to a person skilled in the art.

The block 14 also comprises a plurality of spaced channels 28 extending between the side surfaces 26 to form channeled surfaces 30. The spaced channels 28 allow moisture, humidity, water leaks and the like to flow from one side of the wall partition 12 to the other to prevent their accumulation. The channels 28 are therefore generally perpendicular to the wall surface. The use of the ventilating sill 10 may therefore limit or prevent wall humidity and/or mold builds up. The ventilating sill 10 may further comprise a screen mesh insect barrier 20 positioned over the channeled surfaces 30 to provide a shield or barrier from pests and insects.

In a preferred embodiment, on each side surface 26, a slat 16 is mounted upwardly towards the wall partition 12 at a substantially right angle to the support surface 22 The slats 16 define a support area positioned on the support surface 22. The pair of slats 16 is generally adapted to guide the wall partition 12 onto the support surface 22. The pair of slats 16 may also comprise spring clips or any other fastener types for securing the wall partition 12 onto the ventilating sill 10, as known to a person skilled in the art. The slats 16 are preferably made from plastics, composites or metals. Understandably, any other materials and/or shapes maybe used as known to a person skilled in the art.

In a preferred embodiment, the support surface 22 comprises at least one aperture 18 communicating between the support area and an ambient environment. The aperture 18 aims at allowing the ventilation of the support area and the draining of any moisture and humidity therefrom, In some environments, it is preferable to have multiple apertures 18 to aim at further increasing the ventilation efficiency.

Figures 7A, 7B:
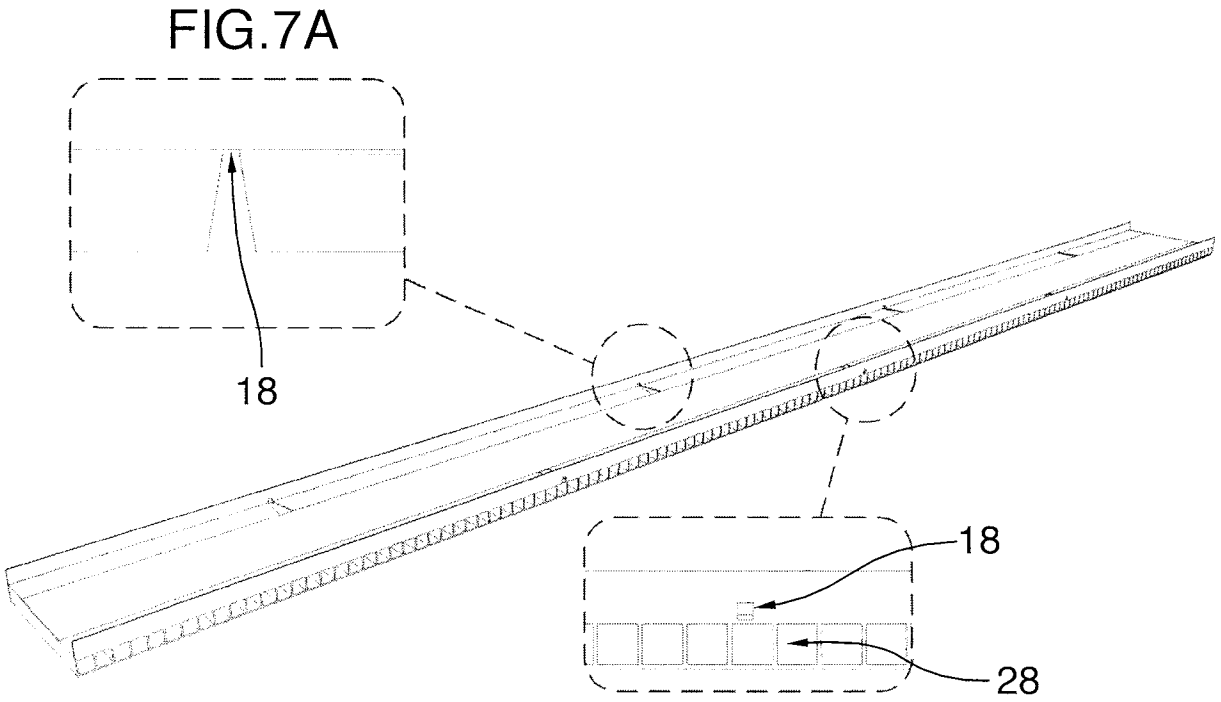
FIG. 7A is a closed-up view of a portion of the ventilating sill in accordance with the principles of the present invention.
FIG. 7B is a closed-up view of another portion of the ventilating sill in accordance with the principles of the present invention.

Now referring to FIGS. 7A and 7B, the aperture 18 in illustrated in more details. Specifically, the aperture 18 is preferably located at a junction point between the slats 16 and the support surface 22. In a preferred embodiment, a slope is defined between the surface 22 and the aperture 18 as to guide the water to the outside environment. The apertures 18 are preferably linearly disposed along the length of the sill 10. The distance between consecutive apertures may be varied depending environmental parameters, such as level of risk of flooding event and percentage of humidity of the ambient air where the wall is to be installed.

Figures 8A, 8B:
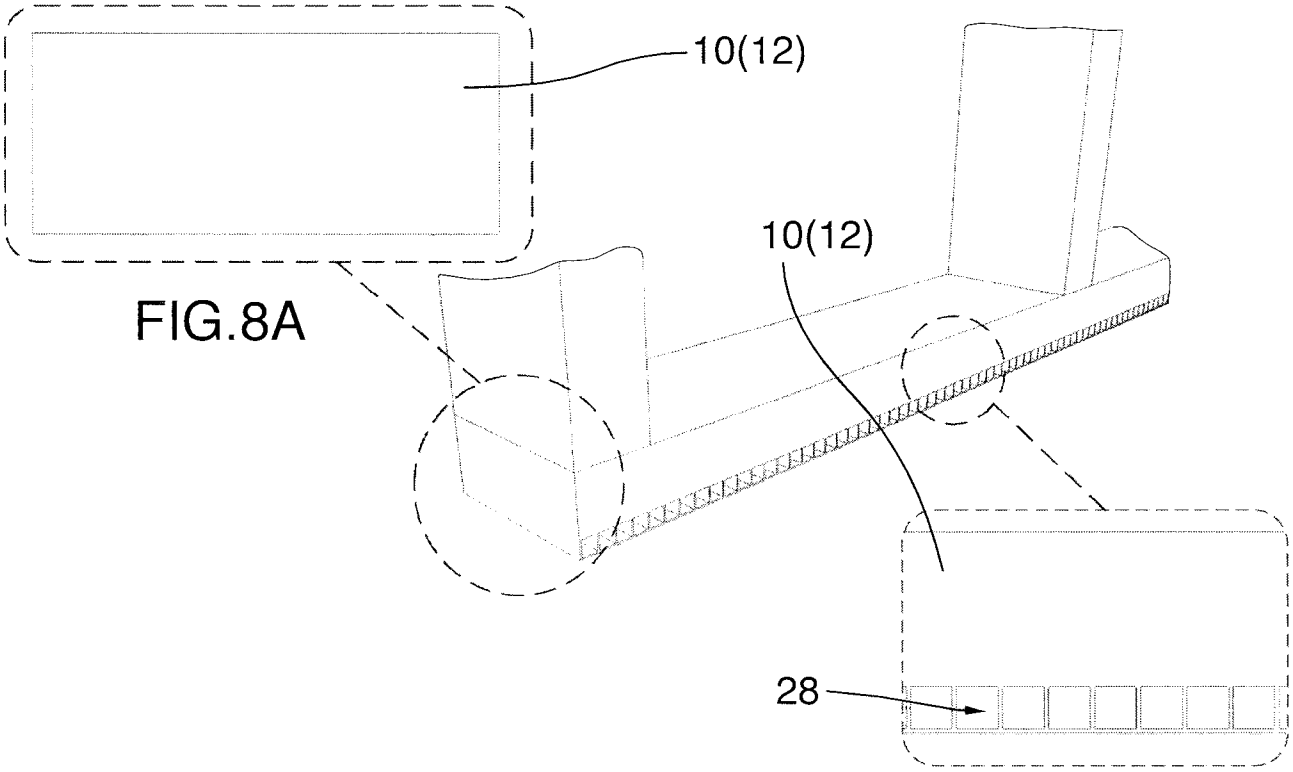
FIG. 8A is a closed-up view of a portion of the ventilating sill in accordance with a second embodiment of the invention.
FIG. 8B is a closed-up view of another portion of the ventilating sill in accordance with a second embodiment of the invention.

Now referring to FIGS. 8A and 8B, another embodiment of the invention is illustrated. In such an embodiment, the wall partition and ventilating sill are integral, such as made from a sole piece of material 10(12), preferably plastics, or composites. Understandably, the material must sustain the force and weight of the above installed wall. The sill, or ventilating wall partition 10(12), comprises channels 28 to generally allow water to flow beneath the wall. The flow of water beneath the wall aims at rendering the entire wall partition to be mold proof For instance, some buildings located in flood prone regions may benefit from such flow of water. In events where flooding or high level of water is generally expected, flowing of water may further reduce damages to the walls or to the wall structure. In a preferred embodiment, such ventilating sill may be used to support division wall or other walls closes to a potential source of water.

In another embodiment, the ventilating wall partition may comprise a plurality of liquid permeable portions and a plurality of load carrying portions vertically superposed and placed in alternation. Each liquid permeable portion may comprise a plurality of spaced apart channels. The plurality of liquid permeable portions is intended to increase the flow of water in a situation where a water level is substantially high. In such a case, water will flow in parallel through both liquid permeable portions.

Figure 9:
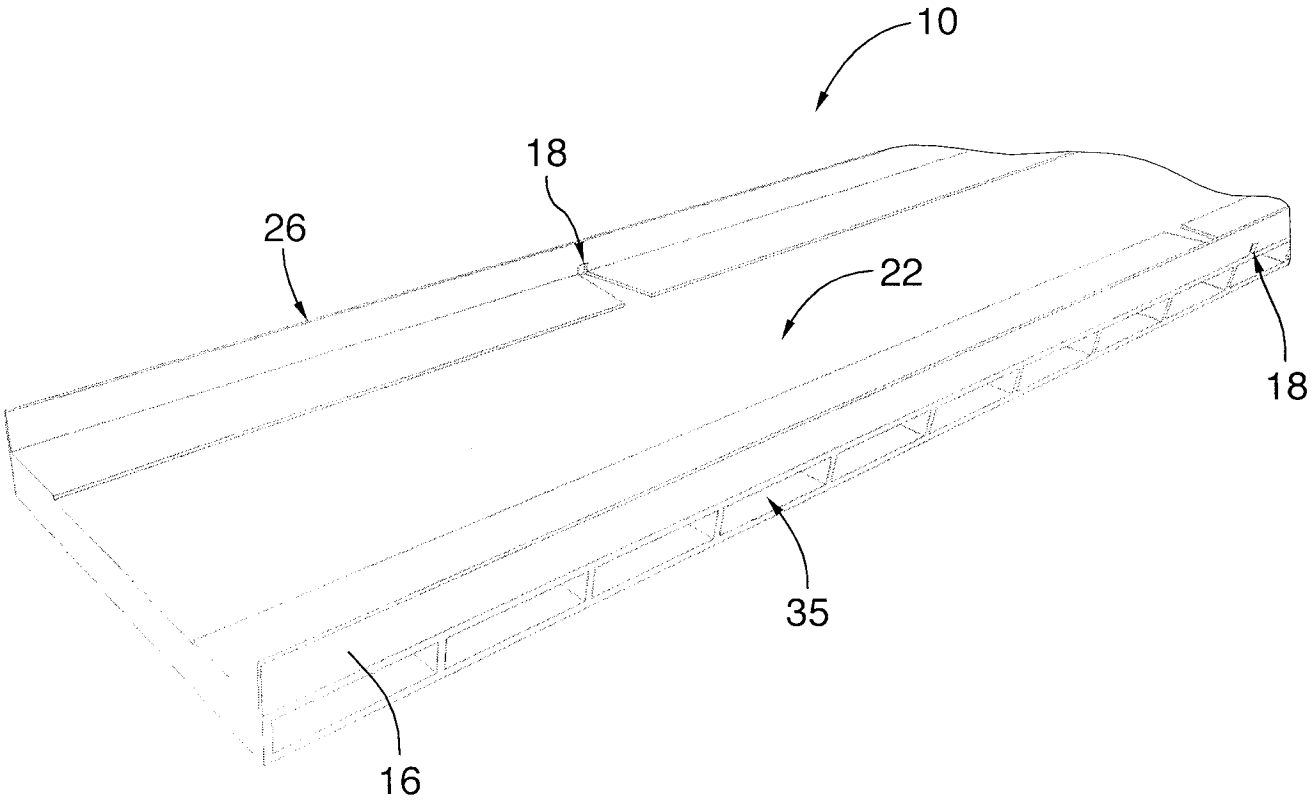
FIG. 9 is a perspective view of the ventilating sill in accordance with a third embodiment of the invention.

Now referring to FIG. 9, a further embodiment of a ventilating sill is shown. In such an embodiment, the ventilation sill comprises wide channels 35. Such wide channels 35 aims at increasing the flow of liquid under the wall structure. Accordingly, the channels may have different shapes or dimensions for different configurations.

Furthermore, although the present invention may be used with various objects, such as wall partitions, for example, it is understood that it may be used with other partitions or structures. For this reason, expressions such as "wall partition", "wall", "partition", "structure", etc. as used herein should not be taken as to limit the scope of the present invention to these construction objects in particular. These expressions encompass all other kinds of materials, objects and/or purposes with which the present invention could be used and may be useful, as can be easily understood.

While illustrative and presently preferred embodiment(s) of the invention have been described in detail hereinabove, it is to be understood that the inventive concepts may be otherwise variously embodied and employed and that the appended claims are intended to be construed to include such variations except insofar as limited by the prior art

The invention claimed is:

1. A ventilating sill for elevating a wall partition from a receiving surface, the ventilating sill comprising:

a body having a support surface, a base surface, and two opposed side surfaces, the body being placeable between the wall partition and the receiving surface, the comprising a plurality of channels each extending between the two opposed side surfaces; and a pair of slats, each one of the pair of slats upwardly extending from the support surface away from the base surface, the slats being adapted to guide the wall partition onto the support surface;

wherein the support surface comprises a first raised portion adjacent to a given one of the pair of slats and a second raised portion adjacent to another one of the pair of slats, the first and second raised portions being spaced apart by an unraised portion, each one of the pair of slats comprising at least one aperture extending therethrough and each one of the first and second raised portions comprising at least one recess communicating with a respective one of the at least one aperture so as to drain the upraised portion of the support surface.

2. A ventilating sill according to claim 1, wherein the body is made from a material selected from a group consisting of plastics, composites, and metals.

3. A ventilating sill according to claim 1, wherein each one of the pair of slats is made from a material selected from the group consisting of plastics, composites, and metals.

4. A ventilating sill according to claim 1, wherein the ventilating sill further comprises a screen mesh insect barrier positioned over the channels.

5. A ventilating sill according to claim 1, wherein at least one of the pair of slats comprises at least one spring clip for securing the wall partition to the ventilating sill.

6. A ventilating sill according to claim 1, wherein at least one of the pair of slats is securable to the wall partition with fasteners.

7. A ventilating wall partition, the wall partition comprising:

a liquid permeable portion comprising a body and slats the body having a support surface, a base surface, and two opposed side surfaces, the body comprising a plurality of channels each extending between the two opposed side surfaces; and each one of the pair of slats upwardly extending from the support surface away from the base surface, wherein the support surface comprises a first raised portion adjacent to a given one of the pair of slats and a second raised portion adjacent to another one of the pair of slats, the first and second raised portions being spaced apart by an unraised portion, each one of the pair of slats comprising at least one aperture extending therethrough and each one of the first and second raised portions comprising at least one recess each communicating with a respective one of the at least one aperture so as to drain the unraised portion of the support surface a load carrying portion being vertically superposed with regards to the liquid permeable portion, the load carrying portion being received between the pair of slats.

8. The ventilating wall partition of claim 7, wherein the load carrying portion is on top of the liquid permeable portion.

9. The ventilating wall partition as claimed in claim 7, the wall partition comprising a plurality of liquid permeable portions and a plurality of load carrying portions vertically superposed and placed in alternation.

10. The ventilating wall partition according to claim 7, wherein the liquid permeable portion and the load carrying portion are made from an anti-mold material.

11. The ventilating wall partition according to claim 10, wherein the anti-mold material is selected from plastic, composite, or metal.

12. The ventilating wall partition according to claim 7, wherein the liquid permeable portion comprises a screen mesh insect barrier positioned over the channels.

13. A method for preventing mold on a wall partition, the method comprising the step of disposing a ventilating sill between the wall partition and a floor, the ventilating sill comprising:

a body having a support surface, a base surface, and two opposed side surfaces, the body comprising a plurality of channels each extending between the two opposed side surfaces; and a pair of slats, each one of the pair of slats upwardly extending from the support surface away from the base surface, the slats being adapted to guide the wall partition onto the support surface;

wherein the support surface comprises a first raised portion adjacent to a given one of the pair of slats and a second raised portion adjacent to another one of the pair of slats, the first and second raised portions being spaced apart by an unraised portion, each one of the pair of slats comprising at least one aperture extending therethrough and each one of the first and second raised portions comprising at least one recess communicating with a respective one of the at least one aperture so as to drain the unraised portion of the support surface.

14. The method of claim 13, the method further comprising the step of attaching the ventilating sill to the wall partition using fasteners or spring clips.

15. The method of claim 13, the method further comprising the step of disposing a screen mesh insect barrier over the channels.

* * * * *